United States Patent [19]

Balch

[11] 4,329,010

[45] May 11, 1982

[54] ELECTRICAL TERMINAL CONNECTOR

[76] Inventor: Robert A. Balch, 2616 SW. Stanley Ct., Portland, Oreg. 97219

[21] Appl. No.: 93,842

[22] Filed: Nov. 13, 1979

[51] Int. Cl.[3] ..... H01R 4/46

[52] U.S. Cl. ..... 339/265 R

[58] Field of Search ..... 339/263, 265, 277; 248/220.3, 220.4, 221.1, 221.2, 300; 33/174 B

[56] References Cited

U.S. PATENT DOCUMENTS

| | | | |
|---|---|---|---|
| 1,976,478 | 10/1934 | Buchanan | 339/265 F |
| 2,499,981 | 3/1950 | Strobel | 339/265 R |
| 2,783,297 | 2/1957 | Badeau | 339/263 L |

FOREIGN PATENT DOCUMENTS

| | | | |
|---|---|---|---|
| 653537 | 2/1935 | Fed. Rep. of Germany | 339/265 F |
| 1358421 | 3/1964 | France | 339/265 R |
| 112242 | 12/1965 | Netherlands | 339/265 |
| 328224 | 2/1958 | Switzerland | 339/265 R |
| 338225 | 6/1959 | Switzerland | 339/265 F |

OTHER PUBLICATIONS

"Electrical World", 11-25-63, p. 38.
Bulletin PSEI; Sep. 1958; p. 10.

*Primary Examiner*—John McQuade
*Attorney, Agent, or Firm*—Wells, St. John & Roberts

[57] ABSTRACT

A flat pad has a pattern of apertures including a first square aperture configuration formed about a center aperture. This first square includes two cylindrical apertures located along a first diagonal plane and two elongated oval apertures located along a perpendicular diagonal plane. A second square pattern of apertures having a shorter side dimension is presented by an outer center aperture. When used in conjunction with a complementary clamp assembly having two rows of three equally spaced apertures, the pad is capable of adapting to a wide variety of cable-to-flat terminal connector requirements.

6 Claims, 17 Drawing Figures

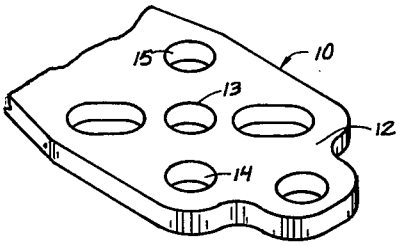
FIG 1
FIG 2
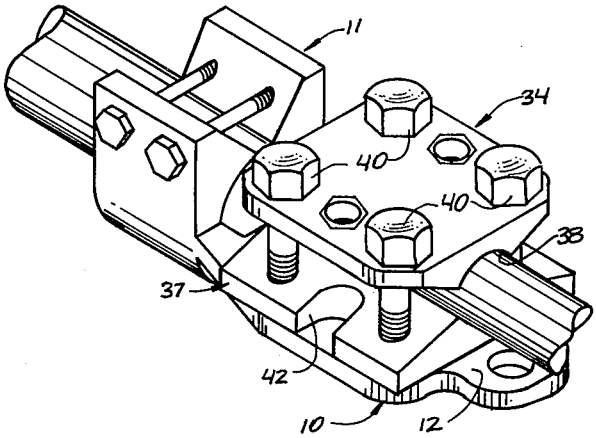
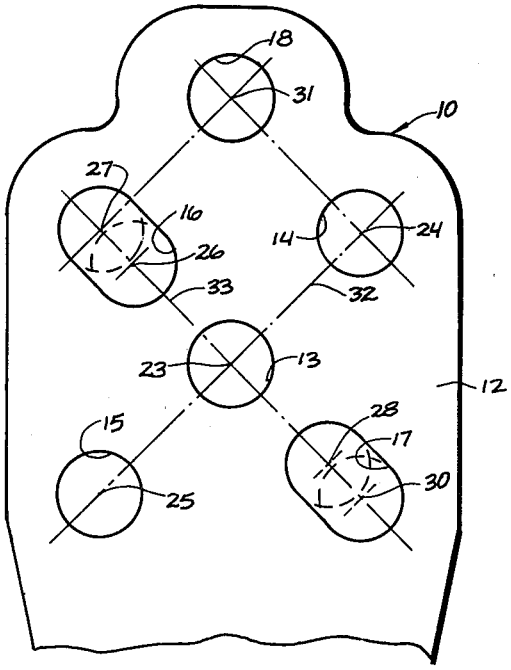
FIG 3
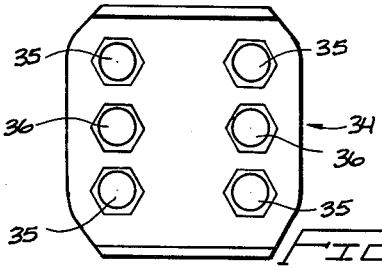
FIG 4
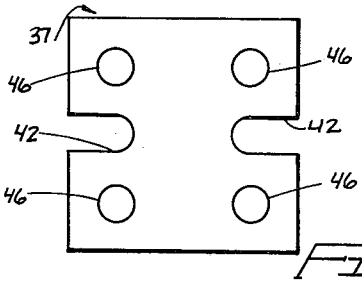
FIG 7
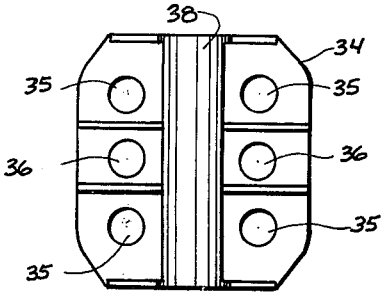
FIG 5
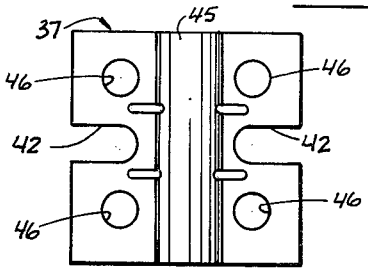
FIG 6

ELECTRICAL TERMINAL CONNECTOR

BACKGROUND OF THE INVENTION

This disclosure relates to connectors used in electrical power distributing systems at terminals where effective connections are required at a flat terminal pad. An example would be at a connection to a transformer, circuit breaker, air switch, bus "tee" or regulator, where electrical cables are interconnected with equipment terminals.

A multitude of such connectors are utilized today in electrical power distributing systems. Separate types of connectors are typically used for single or multiple cable connections, and for accomodating the various offset and angular positions of the cable relative to the mounted terminal. This requires that utilities and personnel designing, installing and maintaining such systems stock a variety of connectors in order to meet inventory requirements. The present power connector assembly was designed to meet the industry need for a versatile connection adaptable to a variety of physical arrangements.

DESCRIPTION OF THE DRAWINGS

FIG. 1 is a front perspective view of a mounting pad;

FIG. 2 is a front perspective view of the assembled terminal connector;

FIG. 3 is a front view of the pad;

FIG. 4 is a front view of a clamp top;

FIG. 5 is a rear view of the clamp top;

FIG. 6 is a front view of a clamp base;

FIG. 7 is a rear view of the clamp base;

DESCRIPTION OF THE PREFERRED EMBODIMENT

Figure 8:
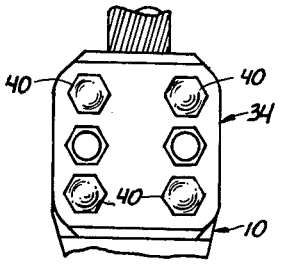
FIGS. 8 through 17 are front views showing typical cable-to-flat connections available by use of the terminal connector.

The electrical power terminal connector shown in the drawings is adapted for use in electrical power transmission and distribution systems, where numerous connections are required between cables and power equipment, such as transformers, switches, circuit breakers and other electrical distribution facilities and equipment. The connector is designed to replace a variety of existing connectors and thereby reduce the inventory costs and physical requirements typically encountered by utilities, contractors and users of electrical power systems.

The connector basically comprises a pad 10 and a clamp assembly including a top 34 and a base 37. Pad 10 is shown in FIGS. 1 and 3, while the complementary clamp assembly is shown in FIGS. 4–7. Typical use of the assembled connector components is illustrated in FIG. 2. A variety of clamping positions for a cable connected to the pad 10 are illustrated in FIGS. 8 through 17.

Pad 10 comprises a unitary metal plate having a front planar surface 12 adjacent an integral mounting assembly 11 by which pad 10 is secured to equipment on which it is fixed. Surface 12 is machined flat. When desired, the back surface of the plate can also be machined flat and serve as a second or alternate mounting surface for a clamp assembly. The mounting assembly 11 is shown in the form of a conventional post clamp for fixing pad 10 to the outer end of a conductive post or terminal (not shown). It is to be understood that mounting assembly 11 might comprise any conventional mounting arrangement for supporting the pad 10. The details of the mounting assembly 11 are immaterial to an understanding of the present invention disclosure.

Pad 10 is designed to replace several different styles of existing flat terminal connectors and to serve as a connector capable of many additional connector configurations as well. It replaces a conventional square four-hold flat connector, a conventional rectangular 90° two-hole flat connector and a conventional rectangular 45° two-hole flat connector. As will be evident below, it is further capable of mounting configurations beyond those available from the conventional flat connectors just described.

A first aperture 13 of preselected width is formed through pad 10 at its center. It has side walls formed through the pad and centered about a first axis 23 perpendicular to the planar surface 12. Second and third apertures 14, 15 of the same preselected width are formed through the pad 10. They each have side walls extending through pad 10 and are respectively centered about second and third axes 24, 25. The axes 24, 25 are parallel to and equally spaced to opposite sides of the first axis 23. They are located within a first straight plane containing axis 23. As illustrated, the first plane is diagonal when the pad 10 is viewed while in a vertical or horizontal orientation.

In the illustrated embodiment of pad 10, apertures 13, 14 and 15 are cylindrical in shape, being adapted to receive conventional cylindrical mounting bolts. However, it must be understood that these apertures might have a polygonal configuration complementary to the shank of a bolt if desired in a particular type of equipment.

Also formed through pad 10 are first and second elongated apertures 16, 17. Each elongated aperture includes an inner end wall and an outer end wall which are tangentially joined by connecting side walls. The first elongated aperture 16 has inner and outer end walls centered about inner and outer axes 26, 27. A second elongated aperture 17 has inner and outer end walls centered about inner and outer axes 28, 30.

The inner axes 26, 28 and the outer axes 27, 30 are respectively parallel to and equally spaced to opposite sides of the first axis 23 along a second straight plane containing the axis 23 and perpendicular to the first straight plane formed through the axes 23, 24 and 25. Again, the second plane is a diagonal plane in a typical upright orientation of pad 10. The first plane is indicated in FIG. 3 by the line 32, while the second plane is indicated by the line 33.

As shown in FIG. 3, the second and third axes 24, 25 and the outer axes 27, 30 of the elongated apertures are located at the corners of a first square centered about axis 23. The sides of this first square are of a prescribed length, typically corresponding to the usual spacing of apertures in a conventional four-hole drilled connector pad.

The inner axes 26, 28 of the elongated apertures are spaced from one another within the second straight plane indicated by line 33 by a distance equal to the preselected length of the sides of the first square defined by the axes 24, 25, 27 and 30.

While the illustrated pad is shown with elongated apertures at two diagonal corners, it is to be understood that they can be located at any two corners or at all four corners, dependent upon specific use requirements and the degree of versatility desired in a particular connector.

Pad 10 includes an outer extension through which is formed a fourth cylindrical aperture 18 centered in alignment with the first aperture 13 between the remaining apertures described above. The fourth aperture 18 has the same preselected width as the apertures 13, 14 and 15. It has side walls centered about a fourth axis 31, which also is parallel to the first axis 23. The spacing between axes 31 and 23 is equal to the length of each side of the first square described above.

The aperture 18 is located at one corner of a square having its remaining corners located at the axes 23, 24 and the outer axis 27 of the upper or outermost first elongated aperture 16. The second square just described is turned 45° with respect to the first square and the preselected length of its sides is shorter than the preselected length of the sides of the first square.

Pad 10 is used in conjunction with a six aperture clamp assembly illustrated in FIGS. 4–7. Clamp top 34 comprises a generally square plate having a groove 38 along its backside for receiving a cable or tube. Clamp base 37 has a complementary shape with a mating groove 45 along its backside.

Clamp top 34 includes four outside apertures 35 arranged in a square configuration and a pair of center apertures 36. The apertures 35, 36 are arranged in two parallel rows spaced apart by a distance complementary to the spacings of the apertures formed on pad 10 so as to suitably mount bolts or other connecting elements between the pad 10, clamp top 34 and base 37. The axes of the apertures 35, 36 are equally spaced along two straight planes separated by a distance equal to the length of each side of the first square presented by the apertures on pad 10. The center axes of the outer apertures 35 are located at the corners of a square having sides of the same preselected length as the sides of the first square on pad 10.

Clamp base 37 also is provided with four corner apertures 46 corresponding to the apertures 35 in clamp top 34. When desired, apertures 46 may be threaded to allow the clamp assembly to be attached to a cable prior to mounting the clamp assembly to pad 10. In this instance, the bolts securing clamp top 34 to clamp base 37 would extend through pad 10 and be secured against its back surface by locking nuts (not shown).

Clamp base 37 has a pair of transverse center slots 42 corresponding to the center apertures 36 on clamp top 34. They freely surround a bolt received through them.

Figure 9:
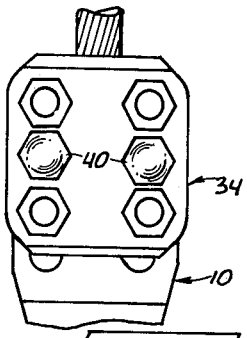
Figure 10:
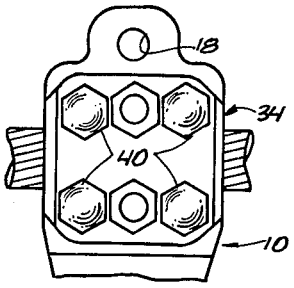
Figure 11:
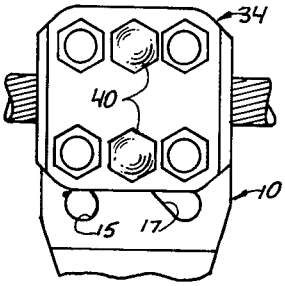
Figure 12:
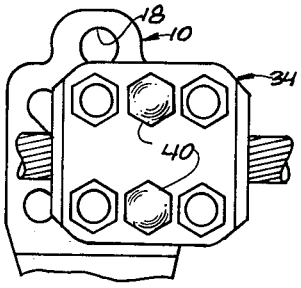
Figure 13:
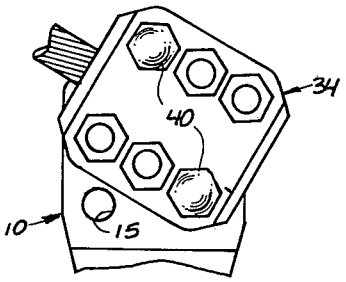
Figure 14:
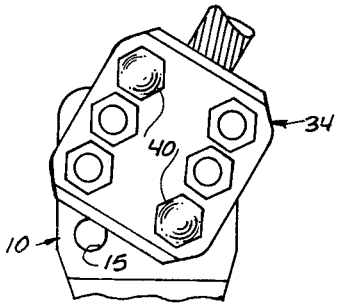
Figure 15:
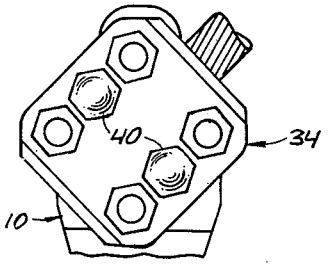
Figure 16:
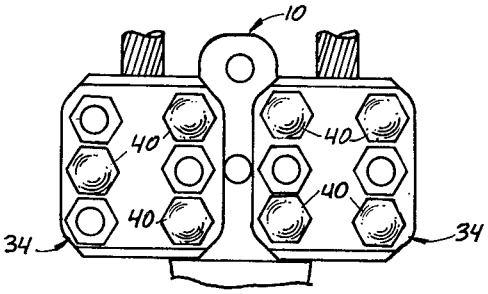
Figure 17:
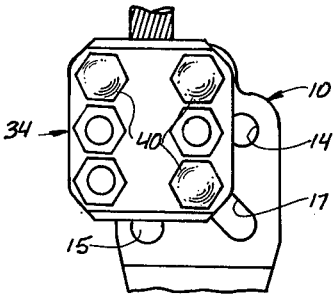

The equally spaced apertures 35, 36 and 46, plus slots 46 in the clamp assembly complement the spacing of the apertures on pad 10 so as to permit clamp assembly to be juxtaposed to pad 10 in a wide variety of positions, as illustrated in FIGS. 8 through 17. In these figures, the clamping bolts are designated at 40. These include vertical positions (FIGS. 8 and 9), horizontal positions (FIGS. 10, 11 and 12, angular positions of 30°, 60° and 45° (FIGS. 13, 14 and 15 respectively), duplex mountings (FIG. 16), and offset positions (FIGS. 9, 10 and 17). These are achieved by varying the spatial position of clamp assembly relative to pad 10 and by proper selection of the apertures on each component through which mounting bolts 40 are secured to clamp a cable 41 to the flat pad 10.

In addition to the described clamp assembly, it is to be understood that conventional terminal lugs and clamping components can also be used with the pad when desired or dictated by a particular installation requirement.

Having described my invention, I claim:

1. A pad for en electrical terminal, comprising:

a rigid plate having a planar surface across one side thereof;

a first aperture of preselected width, having side walls formed through the plate and centered about a first axis perpendicular to said planar surface;

second and third apertures of said preselected width, having side walls formed through the plate and centered about second and third axes parallel to and equally spaced to opposite sides of said first axis along a first straight plane containing said first axis;

first and second elongated apertures formed through the plate, each having an inner end wall and an outer end wall tangentially joined by connecting side walls, the inner and outer end walls being respectively centered about inner and outer axes parallel to and equally spaced to opposite sides of said first axis along a second straight plane containing said first axis and perpendicular to said first straight plane;

said second and third axes and said outer axes being located at the corners of a first square centered about said first axis and having sides of first preselected length;

said inner axes of the elongated apertures being spaced from one another within said second straight plane by a distance equal to said first preselected length.

2. A pad as set out in claim 1 further comprising:

a fourth aperture of said preselected width, having side walls formed through the plate and centered about a fourth axis parallel to said first axis;

said fourth aperture being located at one corner of a second square having its remaining corners located at said first and second axes and the outer axis of said first elongated aperture.

3. In combination with the pad set out in claim 1 a terminal clamp assembly comprising:

a pair of rigid plate members each having two parallel rows of mounting apertures complementary to the apertures on the pad, each row including first, second and third mounting apertures with center axes thereof equally spaced along a straight plane, the center axes of the outer four mounting apertures within said rows being located at the corners of a square having sides of said first preselected length.

4. A pad for an electrical terminal comprising:

a rigid plate having a planar surface across one side thereof;

a plurality of parallel apertures formed through the plate and centered along axes perpendicular to said planar surface, said apertures being shaped and arranged across the planar surface as follows:

a first cylindrical aperture having walls of a preselected radius formed about a first center axis;

second and third cylindrical apertures each having walls of said preselected radius and respectively formed about second and third center axes equally spaced to opposite sides of the first center axis along a first straight plane including said first center axis;

first and second oval apertures each having inner and outer semi-cylindrical end walls of said preselected radius formed about center axes that are respectively equally spaced to opposite sides of the first center axis along a second straight plane intersecting the first center axis and perpendicular to said first straight plane;

the center axes of the outer semi-cylindrical end walls of the first and second oval apertures and said second and third axes being located at the corners of a first square centered about said first axis and having sides of a preselected length;

the center axes of the inner semi-cylindrical end walls of the oval apertures being spaced apart along said second straight plane by a distance equal to the preselected length of the sides of said first square.

5. A pad as set out in claim 4 further comprising:

a fourth cylindrical aperture having walls of said preselected radius and formed about a fourth center axis;

the center axis of said fourth cylindrical aperture, the center axes of said first and second cylindrical apertures, and the center axis of the outer end of said first oval aperture being located about said planar surface at the respective corners of a second square.

6. A pad as set out in claim 5 wherein the sides of said first square are longer in length than the sides of said second square.

* * * * *